US005679246A

United States Patent [19]

Wilcox et al.

[11] Patent Number: 5,679,246

[45] Date of Patent: *Oct. 21, 1997

[54] SPILL CONTAINMENT SYSTEM

[76] Inventors: Jack M. Wilcox, 1313 Bryan Dr., Bedford, Tex. 76022; Keith D. von Kohn, 3903 Parket Oaks Ct., Arlington, Tex. 76106

[ * ] Notice: The term of this patent shall not extend beyond the expiration date of Pat. No. 5,391,295.

[21] Appl. No.: 310,641

[22] Filed: Sep. 22, 1994

Related U.S. Application Data

[63] Continuation-in-part of Ser. No. 127,324, Sep. 27, 1993, Pat. No. 5,391,295.

[51] Int. Cl.[6] ..... E03F 5/14

[52] U.S. Cl. ..... 210/165; 210/170; 210/266

[58] Field of Search ..... 210/163–166, 210/170, 266, 282

[56] References Cited

U.S. PATENT DOCUMENTS

| | | | |
|---|---|---|---|
| 4,172,031 | 10/1979 | Hall et al. | 210/679 |
| 5,297,367 | 3/1994 | Sainz | 210/307 |
| 5,372,714 | 12/1994 | Logue | 210/163 |
| 5,391,295 | 2/1995 | Wilcox et al. | 210/165 |

*Primary Examiner*—Ivars Cintins
*Attorney, Agent, or Firm*—Arthur F. Zobal

[57] ABSTRACT

The containment system provides a simple but automatic closure device that requires minimum and low cost maintenance. Storm water can pass through the drains and does not require manual pumping like the prior art systems. Small mounts of contaminants will be absorbed as the water passes through the drain ensuring the storm water leaving the containment area is free of contaminants. Hydrophobic swellable polymer particles are located in the drain to seal the drain in the event that organic liquids such as oil, gasoline, etc. flow into the drain.

18 Claims, 14 Drawing Sheets

SPILL CONTAINMENT SYSTEM

SPECIFICATION

This application is a continuation-in-part of U.S. patent application Ser. No. 08/127,324, filed Sep. 27, 1993, now U.S. Pat. No. 5,391,295.

BACKGROUND OF THE INVENTION

Field of the Invention

The containment of oil and other organic liquids spills is an ever growing problem that will continue to enlarge with increasing environmental concerns. By building a containment area around the equipment or tank containing the contaminant, a spill would be confined to the area inside the containment area. One of the problems with this concept is that the containment area is outdoors where it is subject to rainfall and dirt or other foreign particles. This invention is a system that will solve these and other problems.

SUMMARY OF THE INVENTION

It is an object of this invention to provide a new and useful drain for preventing spills from escaping the containment site while allowing rain water to pass through this drain.

It is a further object of the invention to provide a drain to be located in a horizontal position for preventing the flow of organic liquids out of a containment area.

DESCRIPTION OF THE PREFERRED EMBODIMENT

Figure 1:
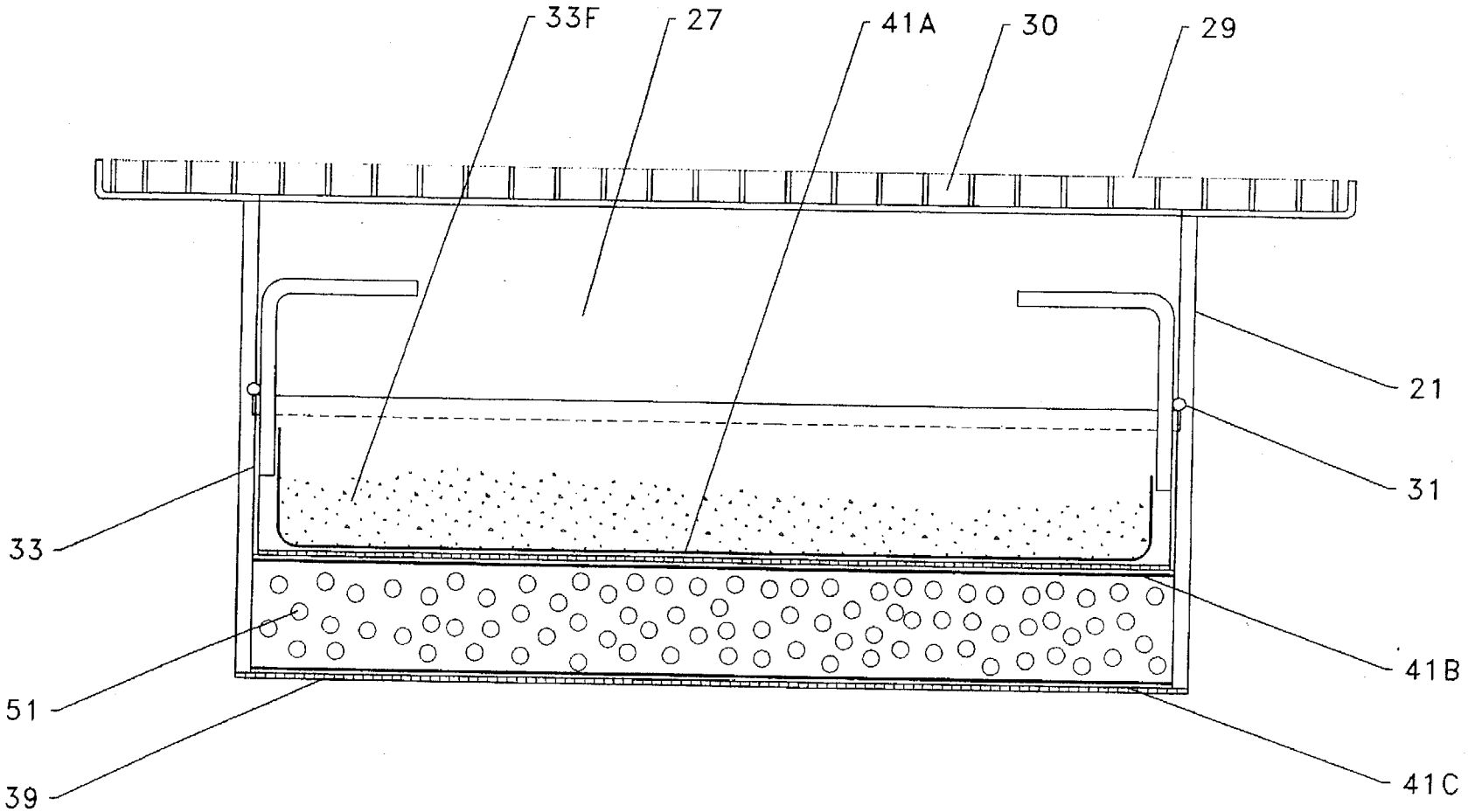
FIG. 1 is a cross-sectional side view of the drain of one embodiment of the invention.
Figure 2:
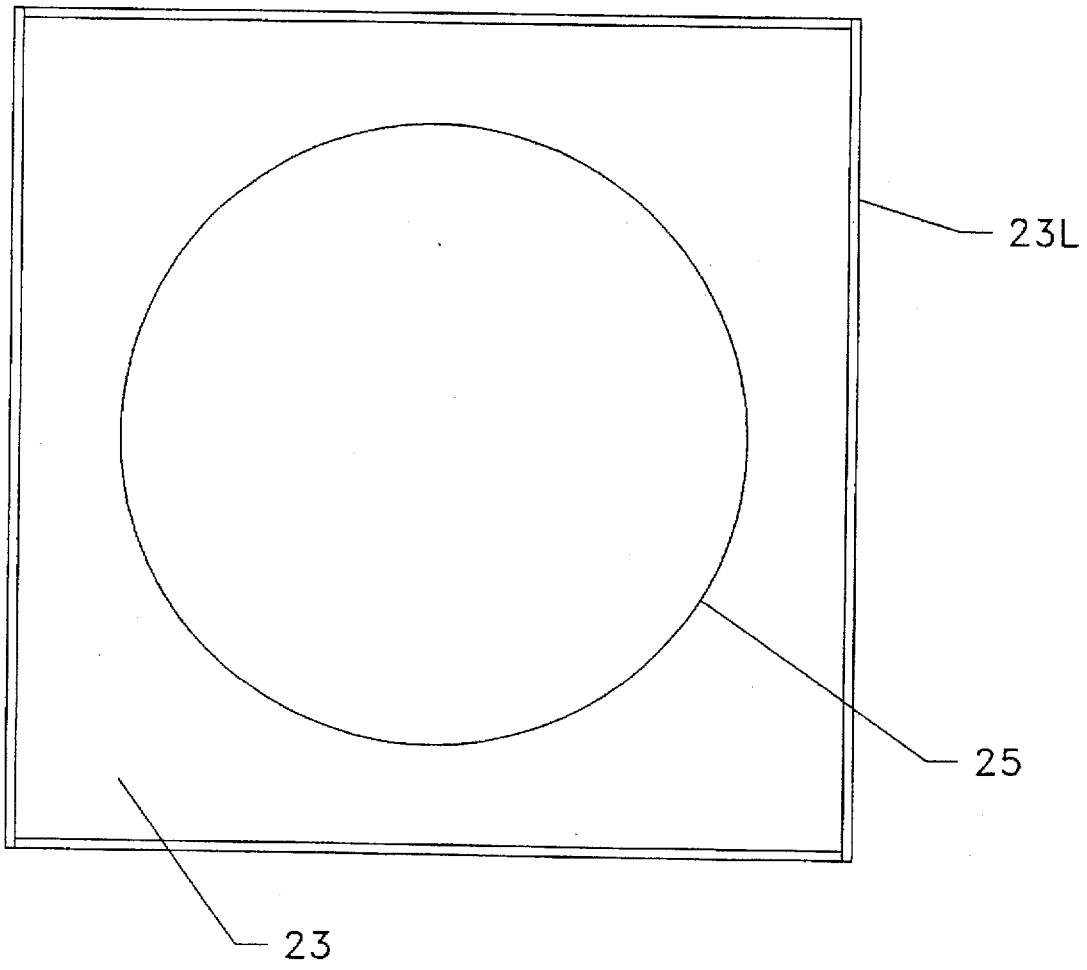
FIG. 2 is a top plan view of the drain of FIG. 1 with the grating removed.
Figure 3:
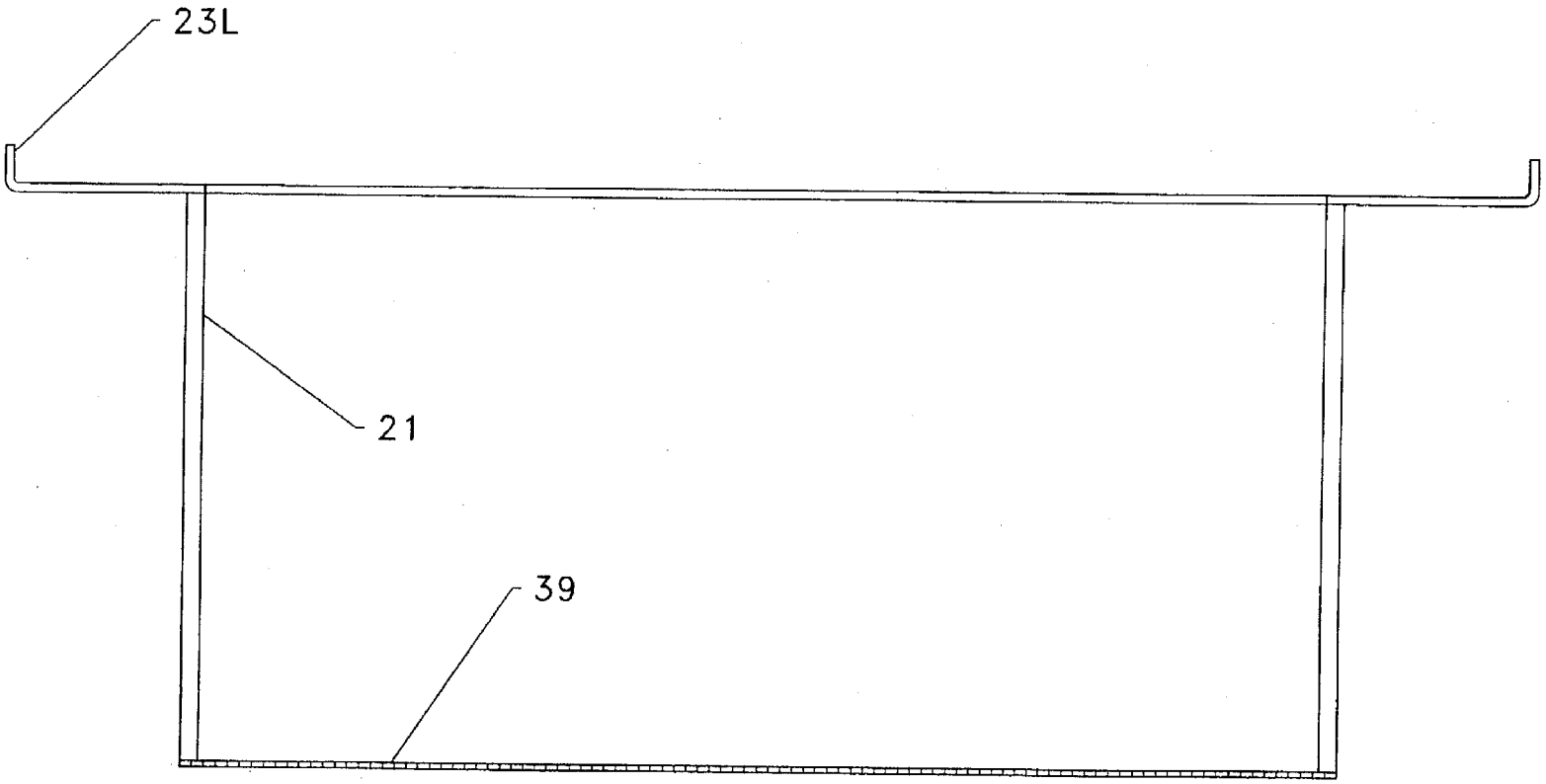
FIG. 3 is a cross-sectional side view of the housing of the drain.
Figure 4:
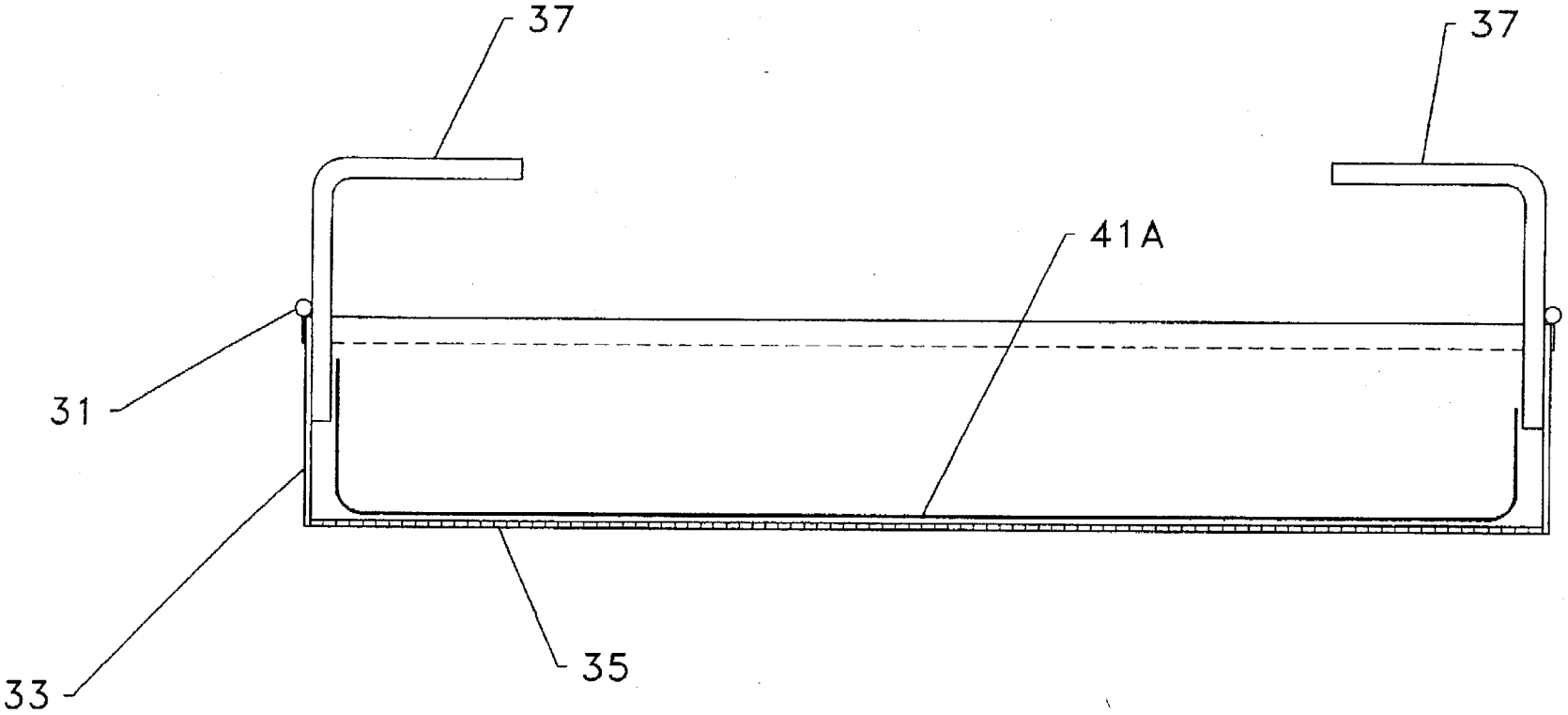
FIG. 4 is a cross-sectional side view of the filter basket of the drain.
Figure 5:
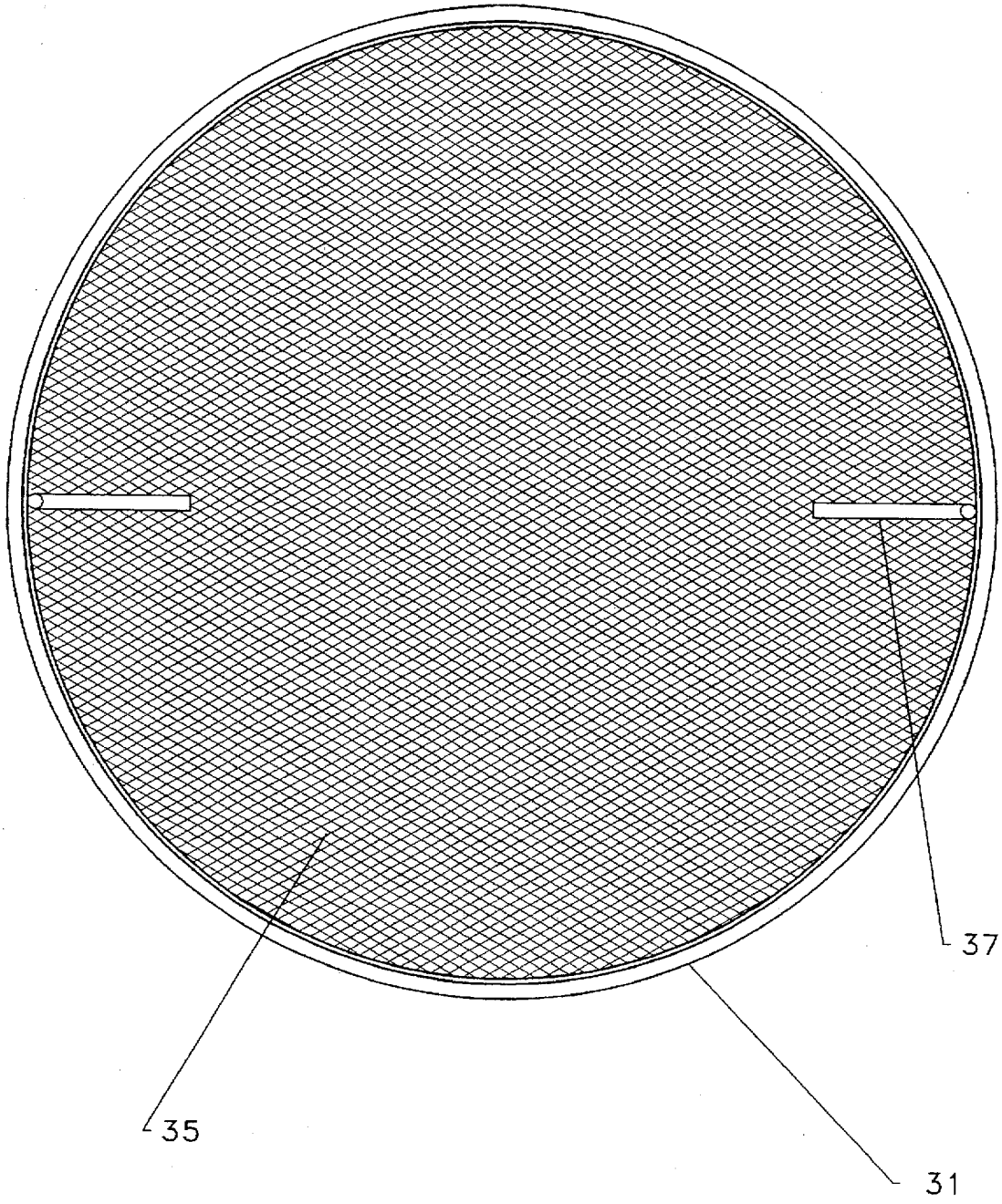
FIG. 5 is a top plan view of the filter basket.

Referring now to FIGS. 1–5, the drain comprises a cylindrical metal wall 21 having a square metal top 23 welded to the top edge of the wall 21. The top 23 has a circular opening 25 formed therethrough in alignment with the central opening 27 of the housing 21. A lip 23L extends upward from the edges of the top 23 and removably holds a galvanized trash grating 29 having openings 30 formed therethrough. A typical housing is formed of one quarter inch thick galvanized metal pipe having an inside diameter of 24 inches. A ring shaped gasket 31 is installed between the inside wall of the housing and the outside wall of the removable cylindrical basket 33. The side wall of the filter basket 33 is typically constructed of 14 gauge sheet metal molded to the proper size and it has an expanded metal bottom 35 (having openings formed therethrough) welded at its bottom on the inside. Two on half inch diameter bent rods 37 are welded to the inside of the filter basket for use as handles. After construction the filter basket is hot dipped galvanized. Layers of geotextile material 41A and 41B are located on top of the expanded metal 35 and below the filter basket 33. This geotextile is a nonwoven polyester needle punched engineered fabric manufactured by Hoechst Celenese Corporation and sold under the trademark TREVIRA SPUNBOND®. An expanded metal bottom 39 is welded to the bottom of the housing 21. The bottom 39 (having openings formed therethrough) is the same as the bottom 35. The bottom 39 is galvanized and old tar epoxy is sprayed over the galvanized finish to give it extra protection. The expanded metal 35 welded to the filter basket has the same coating. A layer of the geotextile material 41C is located on the top of the bottom 39. The geotextile material layers 41A, 41B and 41C allow water to flow therethrough.

Before the filter basket is inserted in place, the housing 21 is partially filled with hydrophobic swellable polymer granules 51 of the type disclosed in U.S. Pat. No. 3,322,695. The beads have a size between 300 and 500 microns. The layer 41B is then located on top of the beads 51 and the basket 33 inserted in the housing to rest on the beads 51 and layer 41B. The basket 33 is filled with a filter material 33F such as sand.

In one embodiment, the geotextile layers having the following properties:

1. Fabric Weight of 4.2 onces per square yard.
2. Thickness of 7 mils.
3. Puncture Resistance of 65 pounds.
4. Mullen Burst Strength of 225 pounds per square inch.
5. Water Flow Rate of 190 gallons per minute per square foot.
6. Permeability of 0.45 centimeters per second.
7. Sieve size 0.210–0.149 millimeters.

Figure 6:
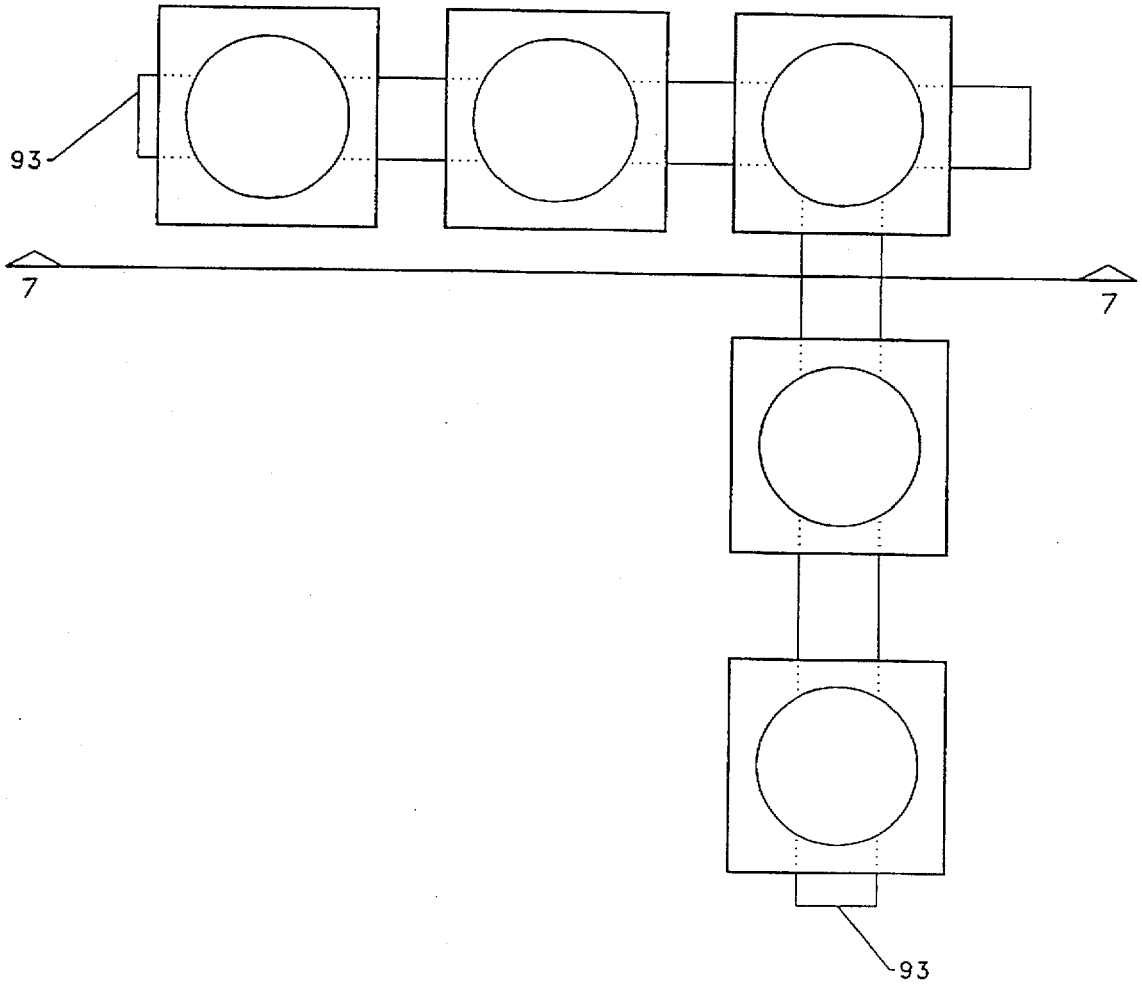
FIG. 6 is a plan view of the manifold system incorporating a plurality of the drains of FIG. 1.
Figure 7:
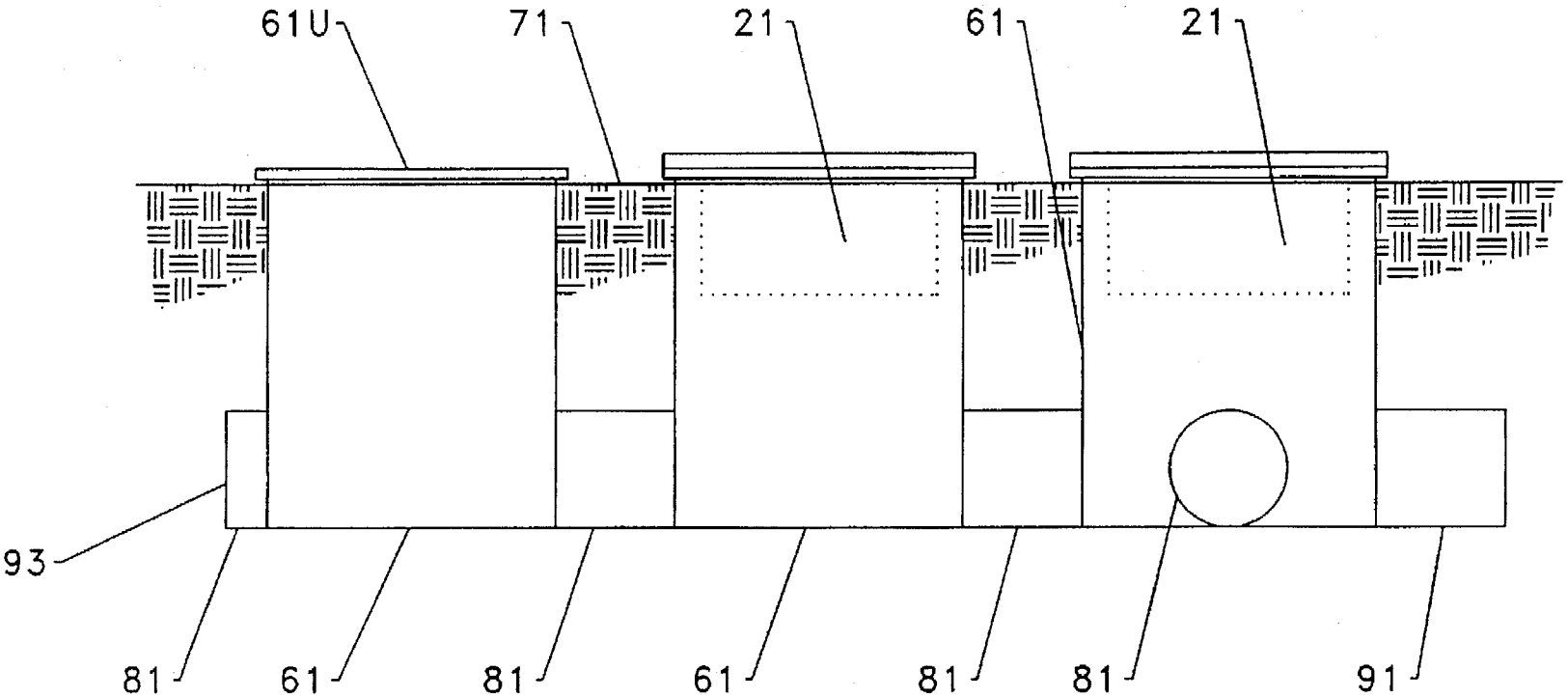
FIG. 7 is a side view of the system of FIG. 6 as seen along lines 7—7 thereof.
Figure 8:
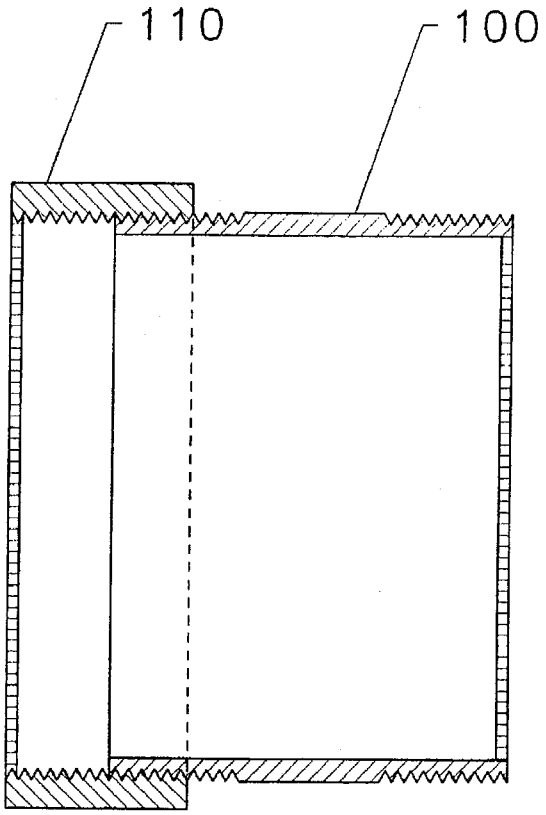
FIG. 8 is a cross-sectional side view of the housing of the horizontal drain of the invention.
Figure 10:
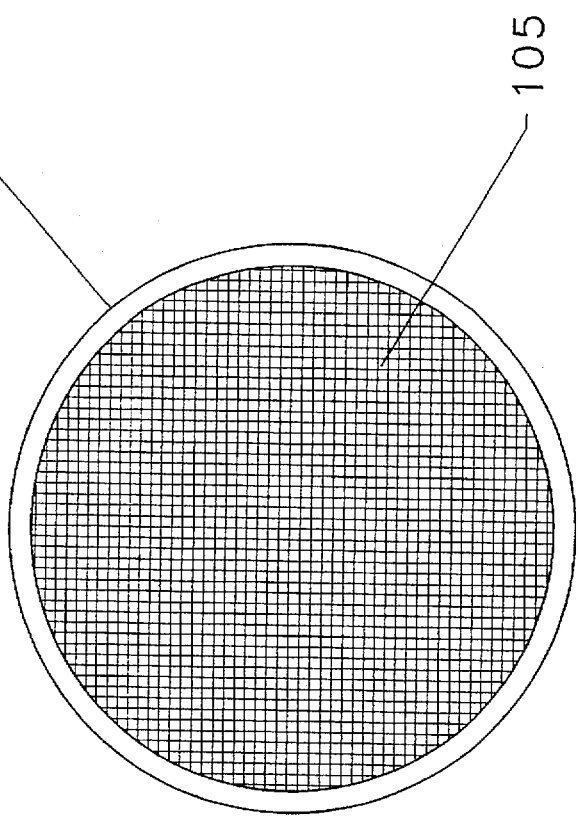
FIG. 10 is an end view of FIG. 9 as seen from the right.
Figure 9:
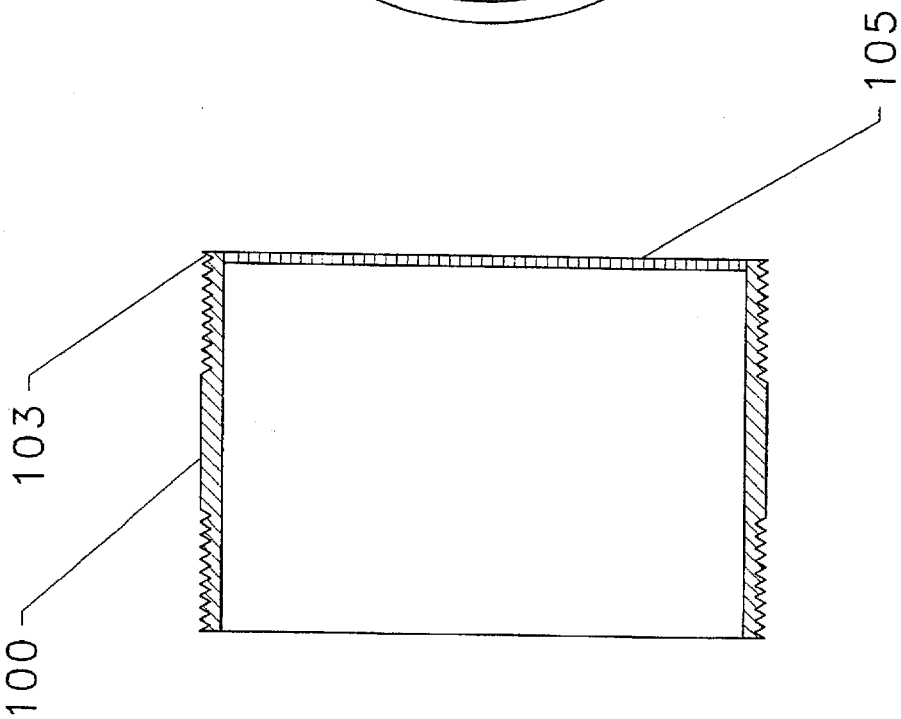
FIG. 9 is a cross-sectional side view of the body of the drain in FIG. 8.
Figure 11:
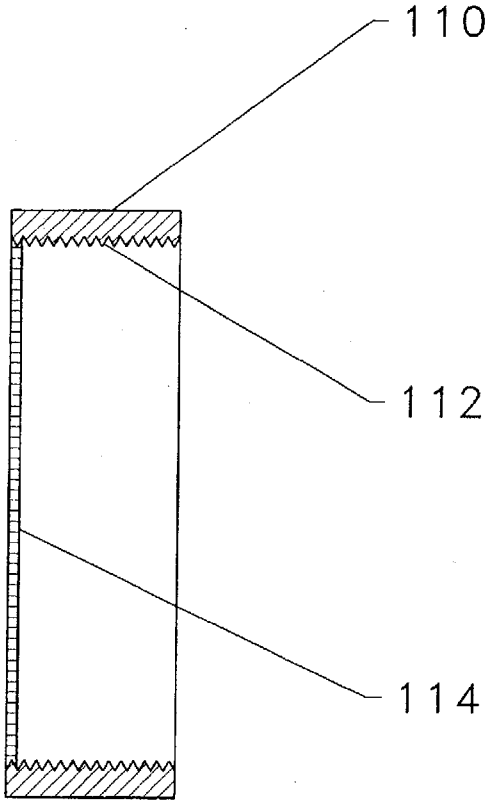
FIG. 11 is a cross-sectional side view of the end cap of the drain in FIG. 8.
Figure 12:
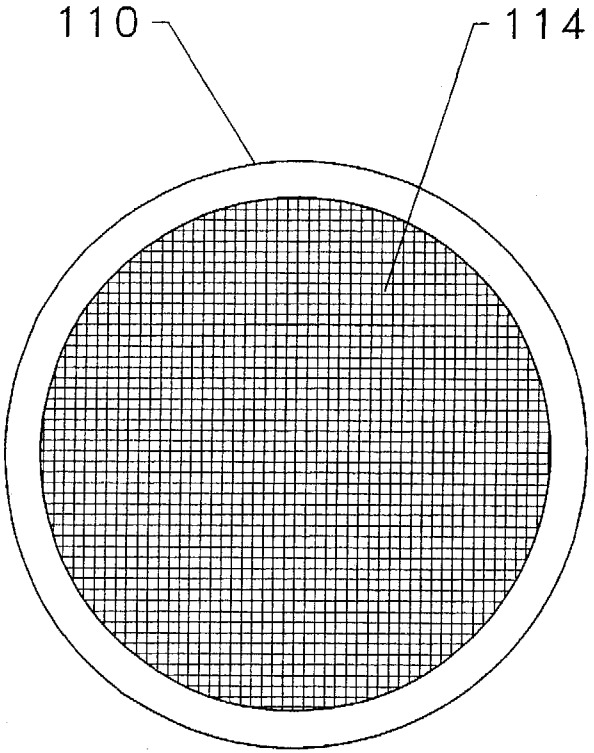
FIG. 12 is an end view of FIG. 11 as seen from the left.

Referring to FIGS. 6 and 7, the manifold system comprises a plurality of hollow cylindrical drain holders 61 located in the ground 71 with pipes 81 connecting the holders 71 together leading to an outlet pipe 91. Each of the holders 61 supports a drain 21 on its upper edge 61 with the drain extending into the holder. In FIG. 7, a drain is shown in dotted form supported by one of the holders. Members 93 are removable caps. In summary the manifold system is comprised of multiple drains connected within a manifold with one common outlet.

The drains consist of several elements. The housing is characteristically a 1 foot deep section of 24 inch diameter galvanized metal pipe with a 32 inch square top welded on top of the pipe and cut out to maintain the 24 inch opening. The 32 inch square top provides a surface to support the drain on top of the manifold. The top of the housing is raised to hold a piece of removable grating sufficiently strong to support a large person's weight. This grating will keep large debris from infiltrating the drain. The housing can be made of several different materials. The bottom is constructed of expanded metal with openings in one embodiment no larger than one quarter of an inch square. Inside the housing different components are installed. Beginning at the bottom, a geotextile fabric is caulked on top of the expanded metal and the housing connect to minimize the area restricting flow. On top of the fabric a layer of hydrophobic swellable polymer material with an indefinite shelf life is installed. The polymer will not absorb water and will let the water drain through. The polymer will however react with organic liquids and swell sufficiently to discontinue the flow of any liquid through the drain. The depth of the material is dependent on the characteristics of the reaction between the polymer and the particular contaminant being contained. Each liquid must be tested to determine the depth of polymer required to seal the system. Above the polymer material another layer of geotextile material is placed to help ensure the integrity of the polymer. A removable filter basket is placed next. This is an integral pan of the design for more than one reason. It provides weight on top of the polymer to force it to swell outward instead of upward and it traps dirt and other small particles that would clog the polymer material and stop or reduce the flow through the drain. Another feature of the filter basket is should the contaminate catch on fire the filter material would keep the fire from burning through the drain. The radius of the basket is constructed approximately one quarter of an inch smaller than the housing to allow for removal. The height of the basket is designed to allow three inches of filter material, typically sand. The bottom of the filter basket is also constructed of expanded metal with openings, in an embodiment of, no larger than one quarter inch square to provide maximum flow rate through the filter material. A layer of geotextile material is placed on top of the expanded metal in the filter basket to ensure the filter material remains separate from the polymer material. The filter material is then placed on the fabric. The complete filter basket can easily be removed using the built in handles to replace the filter material or check the integrity of the material below. A gasket is then placed between the filter basket and the housing to eliminate the contamination of the polymer material below.

Once the components have been installed in the housing, the drain can then be inserted into an opening of the manifold. The opening is several inches larger in radius than the drain for easy installation. The manifold has a flange on top of the opening that matches the square top of the drain to provide a large surface to seal the drain to the manifold to ensure the liquid goes through the drain not around it. Butyl caulk is placed on top of the manifold flange before the drain is placed in the opening to seal it. This establishes a good seal, but, if necessary, does allow a way to remove the drain for replacement or inspection. The depth of the manifold is site dependant due to the surrounding elevations. The connecting outlet pipe is sized according to the number of drains installed. The outlet pipe can be constructed of different materials according to the depth and load bearing requirements.

In this system a manifold with a predetermined number of drain openings is installed in the containment area at the lowest elevation to create a gravity drain. The number of drain openings are calculated to dissipate the rainfall from the area according to a specified flow rate which is also site dependent. Storm water runoff will pass through the sand filter and geotextile and then through the polymer material and finally out the bottom of the drain into the manifold system continuing through the outlet pipe. If a spill occurs, the contaminant will flow to the drains, react with the polymer causing the polymer to swell and seal the drains. This will cause the contaminant to pond around the area where the drains are installed until the contaminant can be removed and disposed of properly. No liquid will be able to pass through the drain until the reacted polymer material is removed and replaced with new uncontaminated material. If a spill occurs during a rainstorm then any water standing prior to the spill will drain until the contaminated water causes the drain to seal.

Some examples of where this system could be used but not limited to these are:

In a containment area surrounding an electric company power transformer filled with insulating oil.

In a diked area surrounding a crude oil storage tank.

In a containment area around gasoline or jet fuel tanks.

Referring now to FIGS. 8–16, the horizontal drain is comprised of two parts, the main body 100 and the end cap 110 screwed together to form a 6 inch long drain. The main body 100 is typically, but not limited to, a piece of 6 inch galvanized metal pipe which is 5 inches long with 1½ inches of external threads 103 at both ends. One end has a ¼ inch by ¼ inch expanded metal (having openings formed therethrough) 105 welded inside and flush with the end of the pipe. The end cap 110 is typically, but not limited to a 2 inch long galvanized metal coupler which has internal threads 112 through the entire cap. One end has a ¼ inch by ¼ inch expanded metal (having openings formed therethrough) 114 welded inside and flush with the end.

Figure 13:
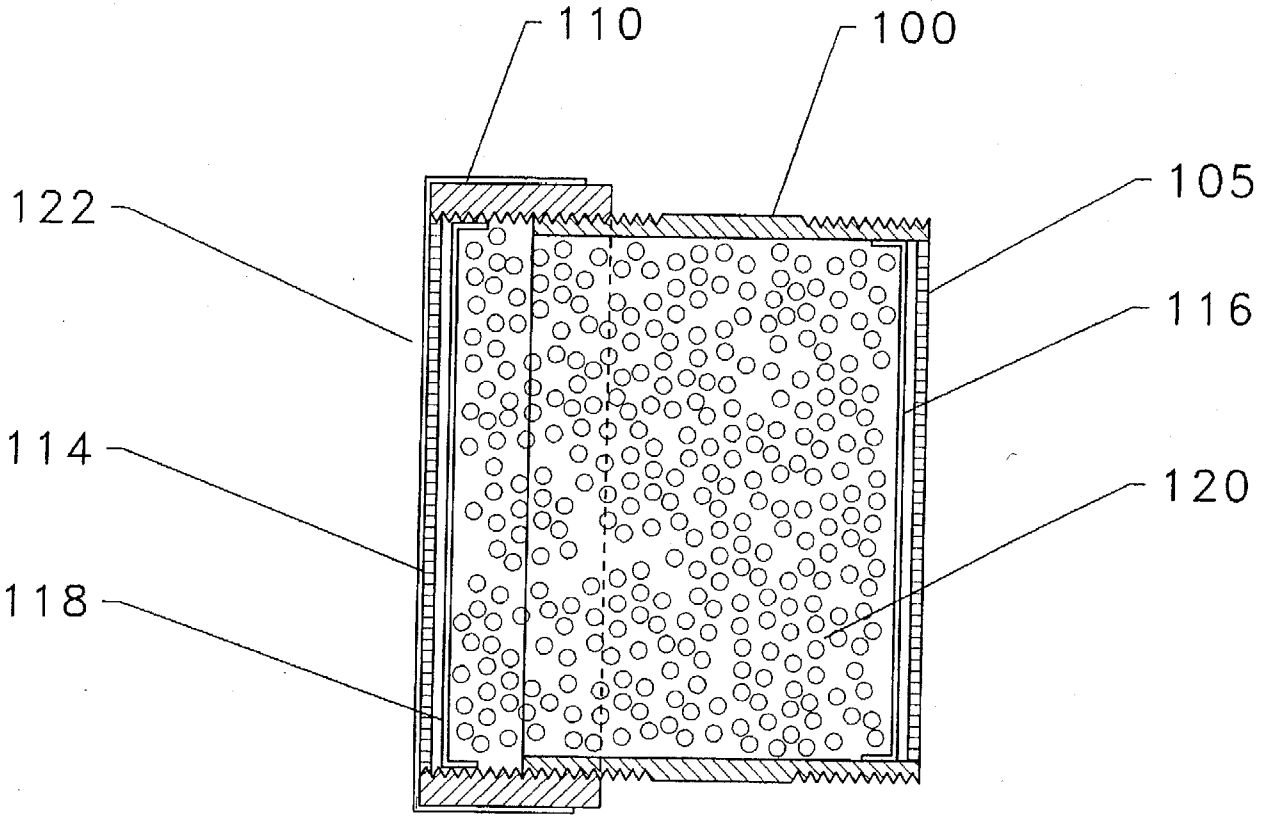
FIG. 13 is a cross-sectional side view of a horizontal drain with swellable polymer installed.

FIG. 13 shows a complete horizontal drain loaded with hydrophobic swellable polymer 120, of the type described previously. A layer of geotextile material 118, of the type described previously, is applied over the entire inside surface of the top of the expanded metal 114 on the inside of the end cap 110 and its outer edge is caulked to the connection of the expanded metal and the end cap. This forms a barrier which allows water to flow through but keeps the polymer 120 from escaping. Another layer of geotextile material 116 is applied over the entire inside surface of the top of the expanded metal 105 on the inside of the main body 100 and its outer edge is caulked to the connection of the expanded metal and the main body. This also forms a barrier on the other end of the drain which allows water to flow through but retains the polymer inside the drain. Once the geotextile material has been caulked inside the end cap and the main body then the polymer 120 can be poured inside both parts. When the end cap 110 and the main body 100 have been filled with the swellable polymer 120 then the two parts can be screwed together. The external threads 103 of the main body 100 should be screwed into the internal threads 112 of the end cap 110 approximately 1 inch to ensure a good connection. A compound such as pipe dope or plumbers putty should be used on the threads to make this connection water tight. A third layer of geotextile material 122 is attached to the outside of the end cap 110 over the entire outside surface as a filter to prevent silts and debris from contaminating the geotextile 118 which is caulked inside the end cap 110. The outside layer of geotextile 122 can be easily changed if and when it becomes contaminated and replaced, making maintenance simple. The preferred material for layers 116, 118, and 122 is the geotextile material although it is understood that other materials may be used for layers 116, 118, and 112.

Figure 14:
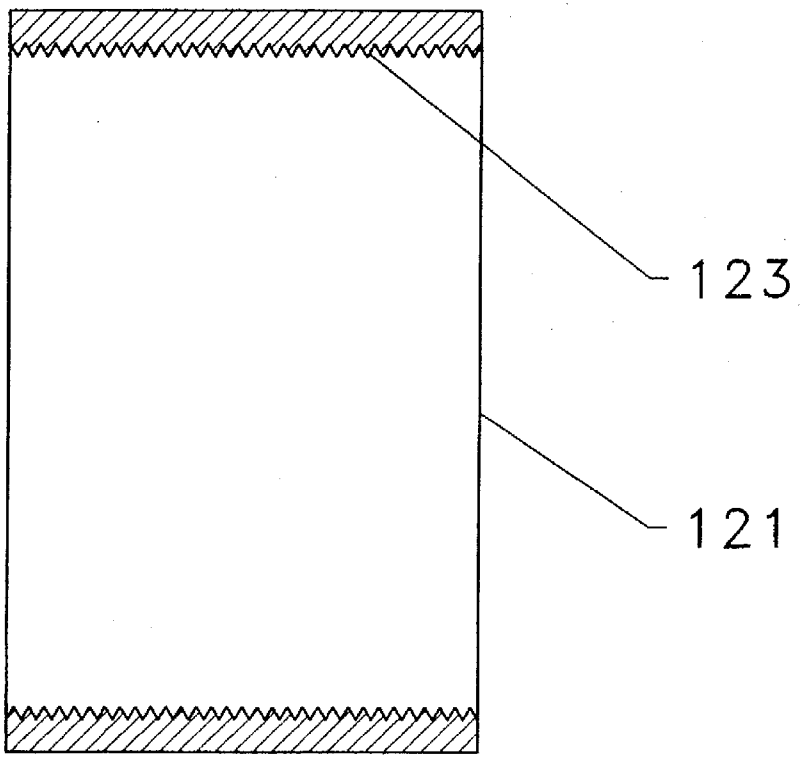
FIG. 14 is a cross-sectional side view of a sleeve which is installed in the containment area into which the horizontal drain is installed.

FIG. 14 shows a sectional view of the sleeve 121, typically, but not limited to, a galvanized metal coupler with internal threads 123 the entire length. The length of the sleeve 121 is site dependant. The sleeve can be installed in different materials for example an earthen berm, concrete or metal wall, etc.

Figure 15:
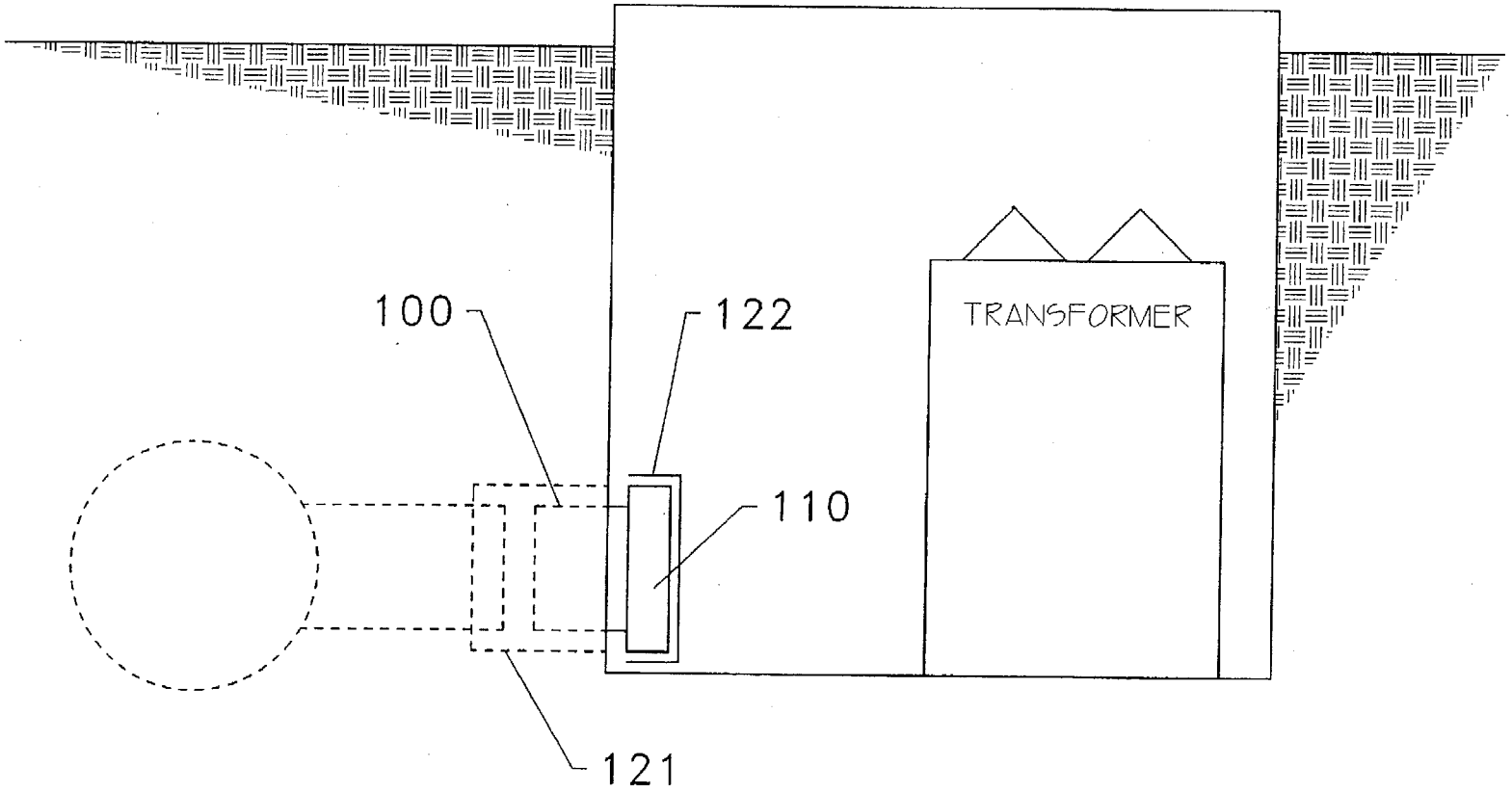
FIG. 15 shows the drain used in a typical underground application.
Figure 16:
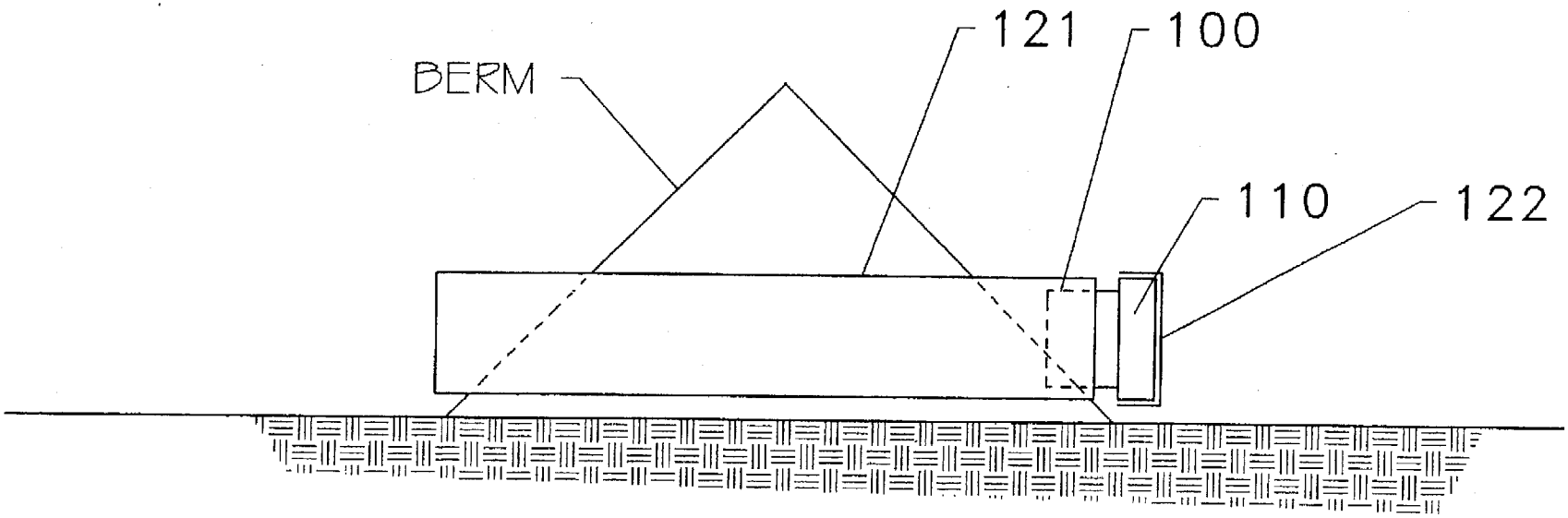
FIG. 16 shows the drain used in a typical above ground application.

The horizontal drain can be installed below the ground as shown in FIG. 15 in a typical below grade transformer vault. In FIG. 15, one end of the sleeve 121 is coupled to the threads 103 of the housing 100 and the other end is coupled to an inlet 131 of a sewer pipe 133. An above ground application is shown in FIG. 16 showing the drain installed in an earthen berm.

The horizontal drain has two main components, the end cap and the main body which are filled with swellable polymer material then screwed together to form a water tight connection. The main body has external threads on the end opposite the end cap which can now be screwed into the sleeve that has been installed in the containment area. Once the drain is installed into the sleeve it works similar to the previously mentioned vertical drain. The swellable polymer is hydrophobic and will allow water to flow through the drain but will react with organic liquids and swell sufficiently to discontinue the flow of any liquid through the drain. The layers of geotextile material allow liquids to flow through the drain while containing the polymer inside. The geotextile material also serves as a filter to prevent silt and debris from contaminating the polymer.

In this system a predetermined number of horizontal drains are installed in the containment area at the lowest elevation to allow a location for the rainfall to flow from the containment area. The number of drains are calculated to dissipate the rainfall from the area according to a specified flow rate which is site dependent. Storm water runoff will pass through the geotextile and then through the polymer material and out the geotextile into the sleeve or outlet. If a spill occurs, the contaminant will flow to the drain, or drains, react with the polymer causing the polymer to swell and seal the drains. This will cause the contaminant to pond around the area where the drains are installed until the contaminant can be removed and disposed of properly. No liquid will be able to flow through the drain until the reacted polymer material is removed and replaced with new polymer.

We claim:

1. A drain, comprising;

a housing having first and second ends with an opening formed therethrough, said first end of said housing forming an inlet to said drain and said second end of said housing forming an outlet of said drain, said housing comprises a cylindrical member having threads at said first and second ends, a cap comprising a cylindrical member having threads adapted to be screwed to said threads at said first end of said housing for removably coupling said cap to said first end of said housing, said cap having an opening formed therethrough, a first member having openings extending therethrough secured across said opening of said cap on the inside of said cap, a second member having openings extending therethrough secured across said opening of said housing at said second end of said housing, a first layer of material porous to water located on the inside of said first member, a second layer of material porous to water located on the inside of said second member, hydrophobic swellable polymer particles located in said opening of said housing between said first and second layers of material porous to water, said hydrophobic swellable polymer particles being characterized in that said particles swell upon reaction with organic liquids to block liquid flow through said drain upon contact with organic liquids, said drain being located in the ground in a generally horizontal position with said first end of said housing and said cap being located in a first zone to be drained of water and a sleeve coupled to said threads of said second end of said housing and extending to a second zone for receiving water from said first zone.

2. The drain of claim 1, wherein:

said first and second layers of material porous to water comprise geotextile material.

3. The drain of claim 1, wherein:

said housing has a given length between said first and second ends with said opening of said housing having about the same cross-sectional size along said given length of said housing.

4. The drain of claim 1, wherein:

said particles have a size of between 300 and 500 microns.

5. The drain of claim 4, wherein:

said hydrophobic swellable polymer particles are located between said first and second layers of material.

6. The drain of claim 5, wherein:

said housing comprises side wall structure which completely surrounds said opening.

7. The drain of claim 1, wherein:

said hydrophobic swellable polymer particles are located between said first and second layers of material.

8. The drain of claim 1, wherein:

said housing comprises side wall structure which completely surrounds said opening.

9. A drain located in a generally horizontal position, comprising;

a cylindrical housing having first and second ends with an opening formed therethrough, said first end of said housing forming an inlet to said drain and said second end of said housing forming an outlet of said drain, threads formed on said second end of said housing, said first end of said housing being located in a first zone to be drained of water, a sleeve having threads screwed to said threads of said housing for receiving water from said first zone only by way of said housing for providing a water passage to a second zone, a first member having openings extending therethrough coupled across said first end of said housing, a second member having openings extending therethrough coupled across said second end of said housing, a first layer of material porous to water located on the inside of said first member, a second layer of material porous to water located on the inside of said second member, hydrophobic swellable polymer particles located in said opening of said housing between said first and second layers of material porous to water, said hydrophobic swellable polymer particles being characterized in that said particles swell upon reaction with organic liquids to block liquid flow through said housing upon contact with organic liquids.

10. The drain of claim 9, comprising:

a cap removably secured to said first end of said housing, said cap having an opening formed therethrough, said first member being secured across said opening of said cap.

11. A drain, comprising:

a cylindrical housing having first and second ends with an opening formed therethrough, threads formed at one of said ends of said housing, a sleeve having threads screwed to said threads at said one end of said housing, said sleeve and said housing being located to provide a passage for water from a first zone to a second zone, a first member having openings extending therethrough coupled across said first end of said housing, a second member having openings extending therethrough coupled across said second end of said housing, a first layer of material porous to water located on the inside of said first member, a second layer of material porous to water located on the inside of said second member, hydrophobic swellable polymer particles located in said opening of said housing between said first and second layers of material porous to water, said hydrophobic swellable polymer particles being characterized in that said particles swell upon reaction with organic liquids to block liquid flow through said housing upon contact with organic liquids.

12. The drain of claim 11, comprising:

a cap removably secured to the other of said ends of said housing, said cap having an opening formed therethrough, one of said members being secured across said opening of said cap.

13. The drain of claim 11, wherein:

said sleeve and said housing are located in a generally horizontal position.

14. The drain of claim 13, wherein:

at least said sleeve is located in a position such that solid material surrounds the exterior of said sleeve.

15. The drain of claim 13, wherein:

at least said housing is located in a position such that solid material surrounds the exterior of said housing.

16. The drain of claim 11, wherein:

at least said sleeve is located in a position such that solid material surrounds the exterior of said sleeve.

17. The drain of claim 11, wherein:

at least said housing is located in a position such that solid material surrounds the exterior of said housing.

18. A drain located in a generally horizontal position, comprising:

a housing having an opening formed therethrough between first and second ends, a cap removably secured to one of said ends of said housing, said cap having an opening formed therethrough, a first member having openings extending therethrough secured across said opening of said cap on the inside of said cap, a second member having openings extending therethrough secured across said opening of said housing at the other of said ends of said housing, a first layer of material porous to water located on the inside of said first member, a second layer of material porous to water located on the inside of said second member, hydrophobic swellable polymer particles located in said opening of said housing between said first and second layers of material porous to water, said hydrophobic swellable polymer particles being characterized in that said particles swell upon reaction with organic liquids to block liquid flow through said drain upon contact with organic liquids, said housing being located in a generally horizontal position such that solid material surrounds the exterior of said housing with said housing providing a flow path for water from a first zone to a second zone.

* * * * *